US010815957B2

(12) United States Patent
Akimoto

(10) Patent No.: US 10,815,957 B2
(45) Date of Patent: Oct. 27, 2020

(54) IGNITION COIL UNIT AND IGNITION SYSTEM, CAPABLE OF SUPPRESSING DEFORMATION OF THE SEAL SECTION, USED IN INTERNAL COMBUSTION ENGINE

(71) Applicant: DENSO CORPORATION, Kariya, Aichi-pref. (JP)

(72) Inventor: Katsunori Akimoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/448,428

(22) Filed: Jun. 21, 2019

(65) Prior Publication Data

US 2019/0390643 A1 Dec. 26, 2019

(30) Foreign Application Priority Data

Jun. 26, 2018 (JP) ..... 2018-120982

(51) Int. Cl.

| | |
|---|---|
| ***F02P 13/00*** | (2006.01) |
| ***F02P 3/04*** | (2006.01) |
| ***F02P 1/00*** | (2006.01) |
| ***F02P 7/067*** | (2006.01) |
| *F02P 17/12* | (2006.01) |

(52) U.S. Cl.

CPC ..... *F02P 13/00* (2013.01); *F02P 1/005* (2013.01); *F02P 3/0442* (2013.01); *F02P 7/067* (2013.01); *F02P 2017/121* (2013.01)

(58) Field of Classification Search

CPC ..... F02P 2017/121; F02P 3/02; H01F 27/04; H01F 38/12; H01F 27/02; H01F 27/28; H01T 13/44

See application file for complete search history.

(56) References Cited

U.S. PATENT DOCUMENTS

| | | | | |
|---|---|---|---|---|
| 4,262,272 A * | 4/1981 | Potter | H01F 27/402 174/17 VA |
| 7,382,220 B2 * | 6/2008 | Keller | H01F 38/12 336/90 |
| 2008/0029074 A1 * | 2/2008 | Anzo | H01F 38/12 123/634 |
| 2012/0227715 A1 * | 9/2012 | Kawai | H01F 38/12 123/634 |

FOREIGN PATENT DOCUMENTS

| | | |
|---|---|---|
| JP | 2007-064041 | 3/2007 |
| JP | 2007-184453 | 7/2007 |
| JP | 2009-281272 | 12/2009 |

* cited by examiner

*Primary Examiner* — Tracie Y Green
(74) *Attorney, Agent, or Firm* — Nixon & Vanderhye P.C.

(57) ABSTRACT

An ignition coil unit is attached to an engine body. The engine body includes a cylinder head having a plug hole and a head cover that covers the cylinder head by including an opening hole facing the plug hole. The ignition coil unit includes a coil unit that generates a high voltage and a cylindrical coupling unit that connects the coil unit with a spark plug. The coupling unit includes a flexible sealing section fitting to an outer peripheral surface of the high tension tower and a harder joint fitting to a tip of the sealing section. The sealing section includes an adhesion portion to tightly contact the head cover and a neck portion at least between the adhesion portion and the joint in a Z-axis direction. The neck portion is formed by partially constricting an outer peripheral surface of the sealing section radially inside.

13 Claims, 13 Drawing Sheets

IGNITION COIL UNIT AND IGNITION SYSTEM, CAPABLE OF SUPPRESSING DEFORMATION OF THE SEAL SECTION, USED IN INTERNAL COMBUSTION ENGINE

CROSS-REFERENCE TO RELATED APPLICATION

This patent application is based on and claims priority to Japanese Patent Application No. 2018-120982, filed on Jun. 26, 2018 in the Japan Patent Office, the entire disclosure of which is hereby incorporated by reference herein.

BACKGROUND

Technical Field

Embodiments of this disclosure relate to an ignition coil unit and an ignition system each used in the internal combustion engine.

Related Art

A conventional ignition coil unit includes a coil body to generate a high voltage and a cylindrical coupling unit to couple the coil body to a spark plug. The coil body includes a primary coil, a secondary coil, and a main housing to accommodate these coils. The coil body also includes a supplemental housing to accommodate a high tension tower that projects from the main housing. The coupling unit includes a sealing section made of rubber fitting to the high tension tower and a joint made of resin fitting to a tip of the sealing section.

Such a conventional ignition coil unit used in an internal combustion engine is sometimes mounted on an engine body including a cylinder head and a head cover to cover the cylinder head. The cylinder head includes a plug hole and the head cover includes an opening hole facing the plug hole. The head cover is arranged with the opening hole coaxial with the plug hole. An ignition coil unit is inserted thru both of the opening hole and the plug hole.

However, in such an engine body, due to either an assembly tolerance allowed when the cylinder head and the head cover are assembled or a size tolerance for either the cylinder head or the head cover, axial misalignment may occur such that an axis of the opening hole of the head cover misaligns with that of the plug hole. When the ignition coil unit is mounted on the engine body with such axial misalignment, a region of the sealing section between the opening hole of the head cover and the plug hole of the cylinder head deforms. Due to this deformation, the sealing section is pressed against a corner of an opening end of the plug hole thereby possibly losing durability.

Various embodiments of the present disclosure are made in view of the above-described problem, and an object of one of these embodiments is to provide a novel ignition coil unit and an ignition system used in an internal combustion engine capable of either suppressing or reducing interference between the sealing section and the opening end of the plug hole.

SUMMARY

Accordingly, one aspect of the present disclosure provides a novel ignition coil unit attached to the engine body to be used in an internal combustion engine. The engine body includes a cylinder head having a plug hole and a head cover having an opening hole facing the plug hole to cover the cylinder head. The ignition coil unit includes a coil body to generate a high voltage and a cylindrical coupling unit to couple the coil body to a spark plug. The coil body includes a main housing to accommodate components of the coil body and a housing to accommodate a cylindrical high tension tower protruding from the main housing in an axial direction thereof. The coupling unit includes both of a flexible sealing section fitting to an outer peripheral surface of the high tension tower and a joint harder than the sealing section. The joint includes a joint fitting section fitting to a tip fitting section formed at a tip of the sealing section. The sealing section includes an adhesion portion to tightly contact the head cover (i.e., at the opening hole). The sealing section includes a neck portion at least between the adhesion portion and the joint in a Z-axis direction. The neck portion is prepared by pinching an outer peripheral surface toward an inner peripheral surface.

Another aspect of the present disclosure provides a novel ignition system that includes: a cylinder head having a plug hole; a head cover to cover the cylinder head by including an opening hole facing the plug hole, and an ignition coil unit inserted into both of the plug hole and the opening hole. The ignition coil unit includes: a coil body to generate a high voltage and a cylindrical coupling unit to couple the coil body to a spark plug. The coil body includes; a main housing to accommodate components included in the coil body, and a housing to accommodate a cylindrical high tension tower protruding from the main housing in an axial direction thereof. The coupling unit fits to the outer peripheral surface of the high tension tower. The coupling unit includes: an adhesion portion to tightly contact the head cover (i.e., at the opening hole); and a neck portion located inside the plug hole at least partially facing an opening end on a base end side at a position closer to a tip thereof than the adhesion portion. An outer peripheral surface of the neck portion is depressed toward an inner peripheral surface.

Now, an exemplary advantage of each of the embodiment of the present disclosure is described herein below. The sealing section included in the ignition coil unit of the first embodiment of the present disclosure includes the adhesion portion to tightly contact the head cover. A joint harder than the sealing section is located in the tip fitting section of the sealing section. Hence, when the ignition coil unit is attached to the engine body, in which axial misalignment occurs between the opening hole of the head cover and the plug hole, axial misalignment may also be generated between the high tension tower and the joint. That is, the high tension tower is guided and located by the opening hole of the head cover via the adhesion portion fitting to the head cover in the sealing section. With this, a central axis of the high tension tower is intended to align with the central axis of the opening hole of the head cover. On the other hand, the joint located in the plug hole is guided and located by the plug hole. With this, a central axis of the joint is intended to align with a central axis of the plug hole. As a result, the high tension tower and the joint generate the axial misalignment. Accordingly, due to the axial misalignment between the high tension tower and the joint, a region between the adhesion portion and the joint deforms in the sealing section.

In view of this, in this embodiment of the present disclosure, the sealing section includes a neck portion, in which at least an outer peripheral surface is depressed in a region between the adhesion portion and the joint in the axial direction. That is, as described earlier, the neck portion is provided in a portion of the sealing section, which is possibly deformed by the axial misalignment between the opening hole of the head cover and plug hole. Hence, even if the axial misalignment occurs between the opening hole of the head cover and the plug hole, the sealing section can be avoided from interfering with the opening end of the plug hole.

Further, in the ignition system of the second aspect of the present disclosure, the coupling unit includes a neck portion located inside the plug hole at least at the opening end on the base end side. Hence, even if the axial misalignment occurs between the opening hole of the head cover and the plug hole, the coupling unit can be avoided from interfering with the opening end of the plug hole.

Hence, as described heretofore, according the above-described embodiments of the present disclosure, the ignition coil unit and the ignition system used in the internal combustion engine rarely interfere with the opening end of the plug hole.

BRIEF DESCRIPTION OF THE DRAWINGS

A more complete appreciation of the present disclosure and many of the attendant advantages of the present disclosure will be more readily obtained as substantially the same becomes better understood by reference to the following detailed description when considered in connection with the accompanying drawings, wherein.

DETAILED DESCRIPTION

Figure 1:
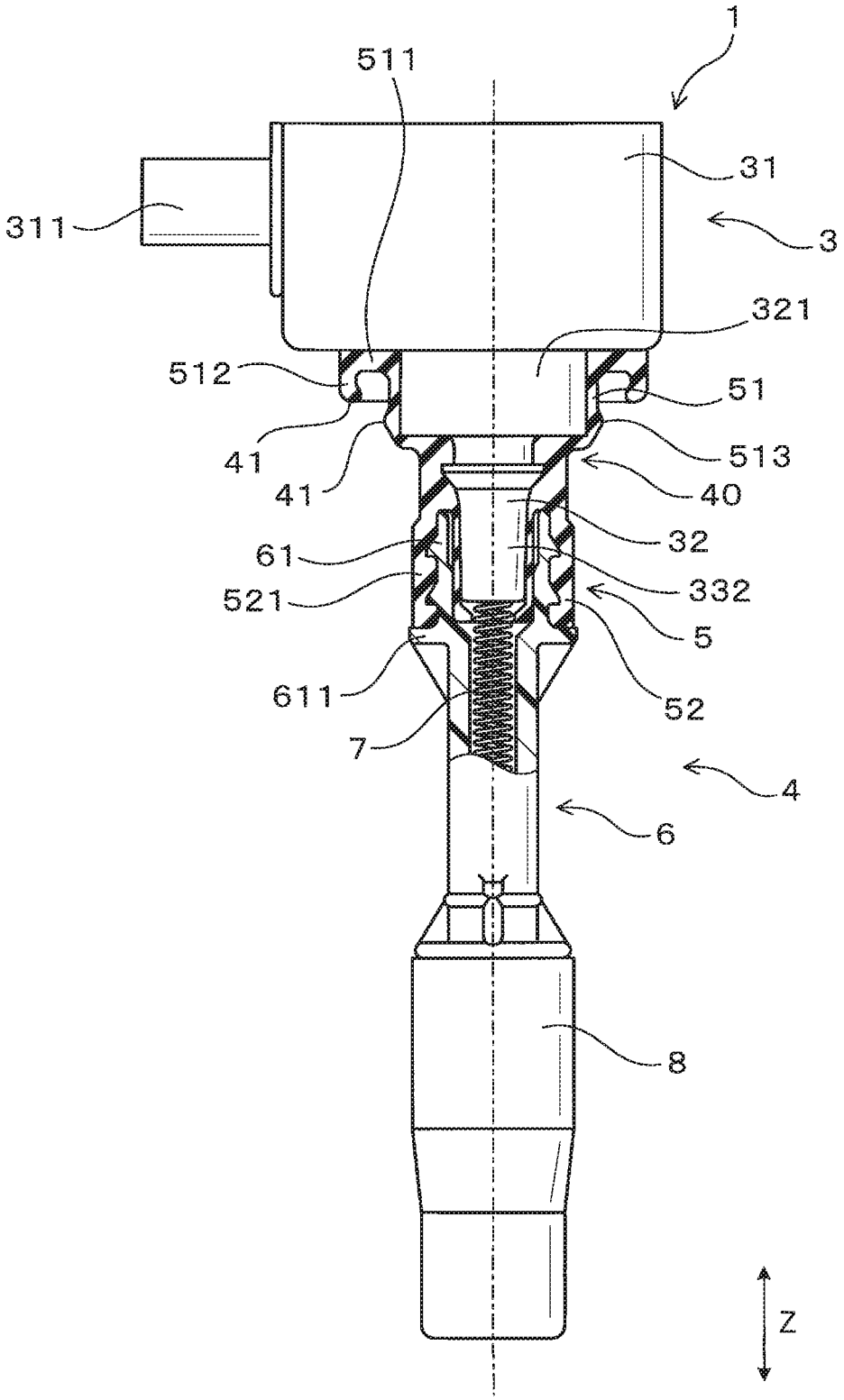
FIG. 1 is a partially sectional front view illustrating an exemplary ignition coil unit according to a first embodiment of the present disclosure.

Referring now to the drawings, wherein like reference numerals designate identical or corresponding parts throughout the several views thereof, and in particular to FIGS. 1 to 4, an exemplary ignition coil unit used in an internal combustion engine is described according to a first embodiment of the present disclosure.

Figure 4:
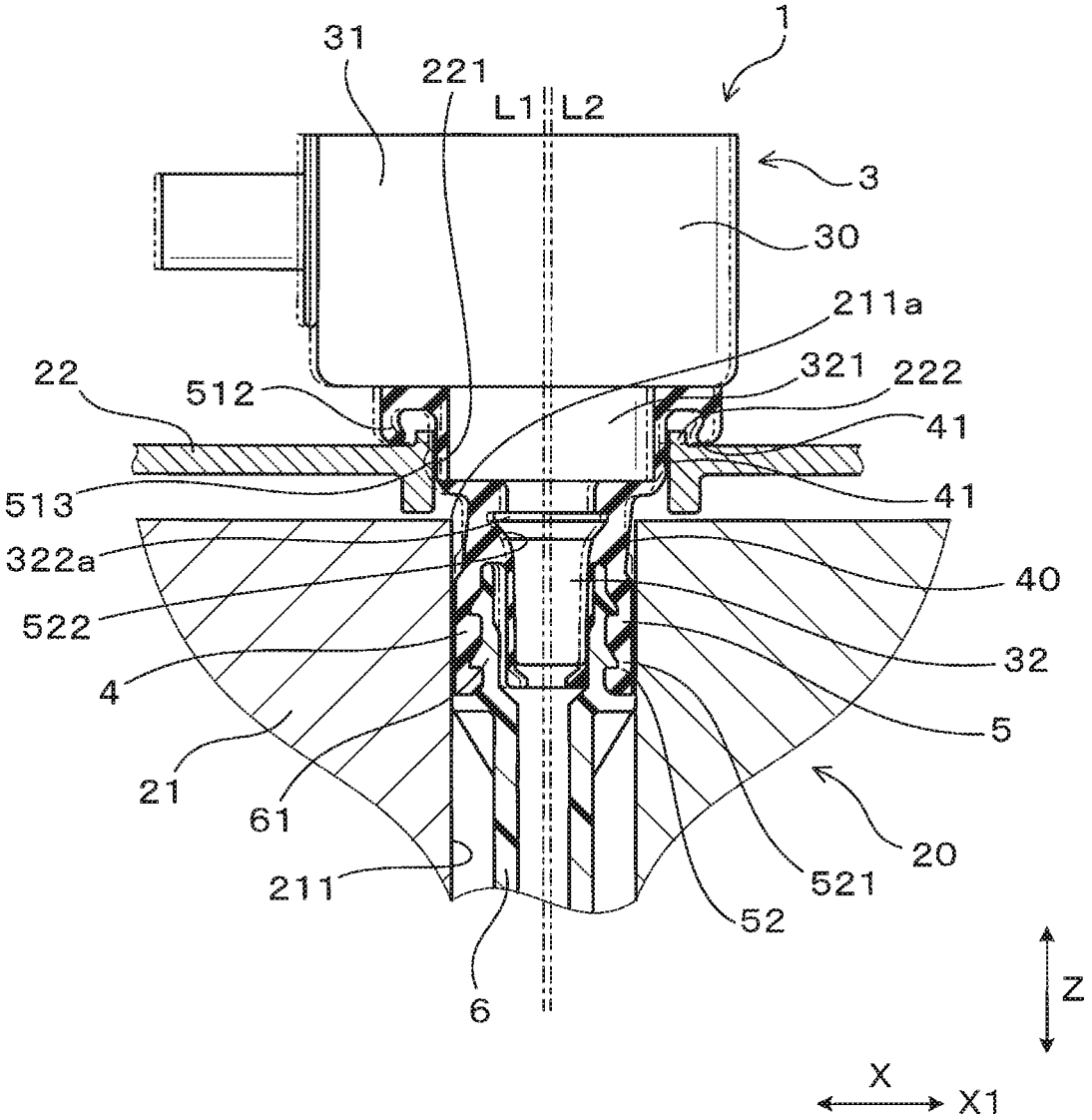
FIG. 4 is a partially sectional front view illustrating the ignition system employing the ignition coil unit of the first embodiment of the present disclosure.

As illustrated in FIG. 4, an ignition coil unit 1 of this embodiment of the present disclosure is attached to an engine unit 20 to be used. The engine unit 20 includes a cylinder head 21 including a plug hole 211 and a head cover 22 that covers the cylinder head 21 with an opening hole 221 facing the plug hole 211.

Figure 3:
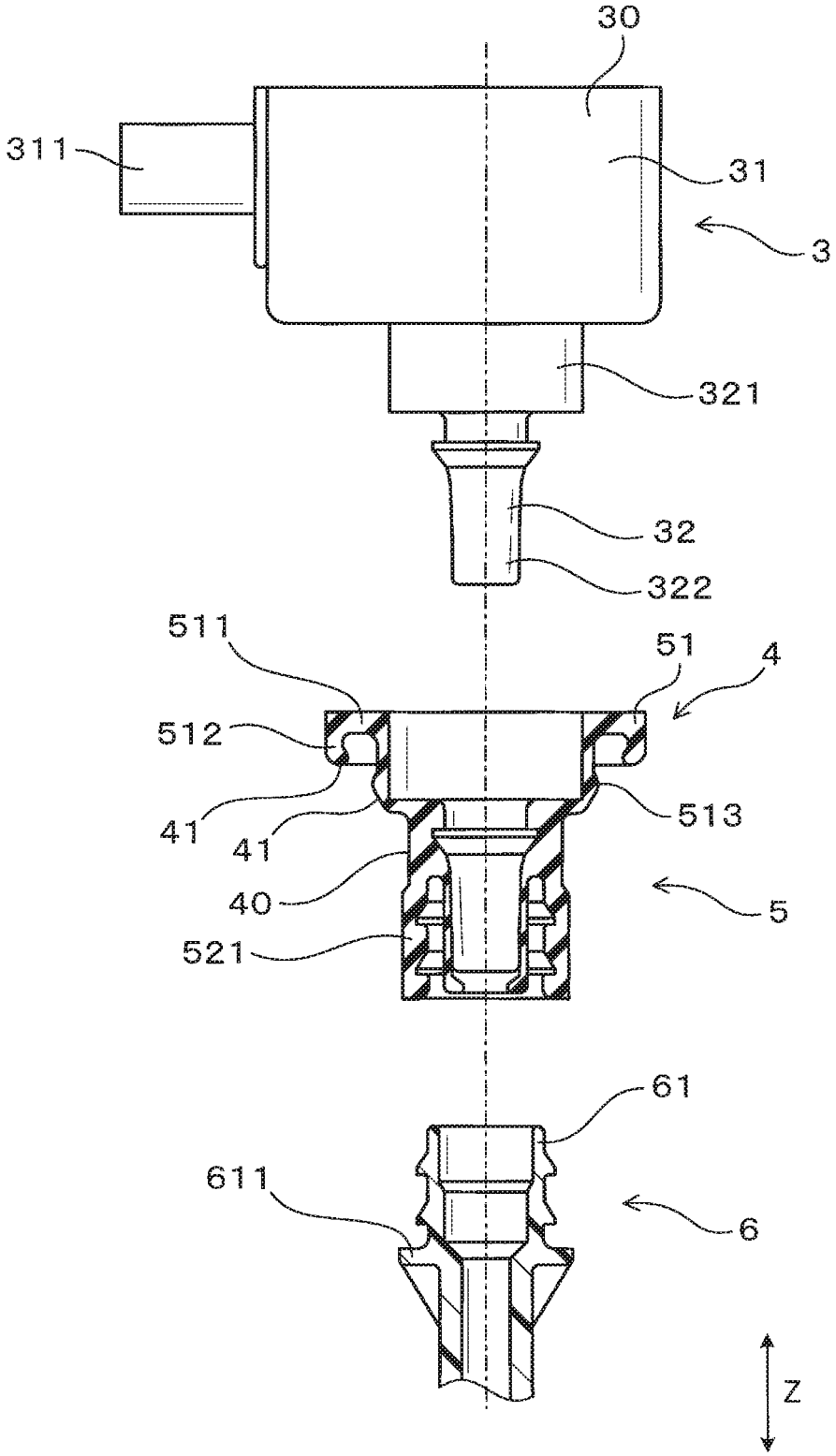
FIG. 3 is a partially sectional exploded front view illustrating the ignition coil unit according to the first embodiment of the present disclosure.

As illustrated in FIGS. 1 and 3, the ignition coil unit 1 includes a coil unit 3 to generate a high voltage and a cylindrical coupling unit 4 to couple the coil unit 3 to a spark plug. The coil unit 3 includes a main housing 31 that houses various components of the coil unit 3 and a housing unit 30 that includes a high tension tower 32. The high tension tower 32 is cylindrical and projects to a tip side (of the ignition coil unit 1) from the main housing 31 in a Z-axis direction.

Further, as illustrated in FIGS. 1 and 3, the cylindrical coupling unit 4 is composed of a sealing section 5 and a joint 6. The sealing section 5 is flexible and fits to an outer peripheral surface of the high tension tower 32 as illustrated in FIG. 1. The sealing section 5 includes a tip fitting portion 521 at a tip thereof. The joint includes a joint fitting section 61 fitting to the tip fitting portion 521 of the sealing section 5. The joint 6 is made of material harder than the sealing section 5.

Figure 2:
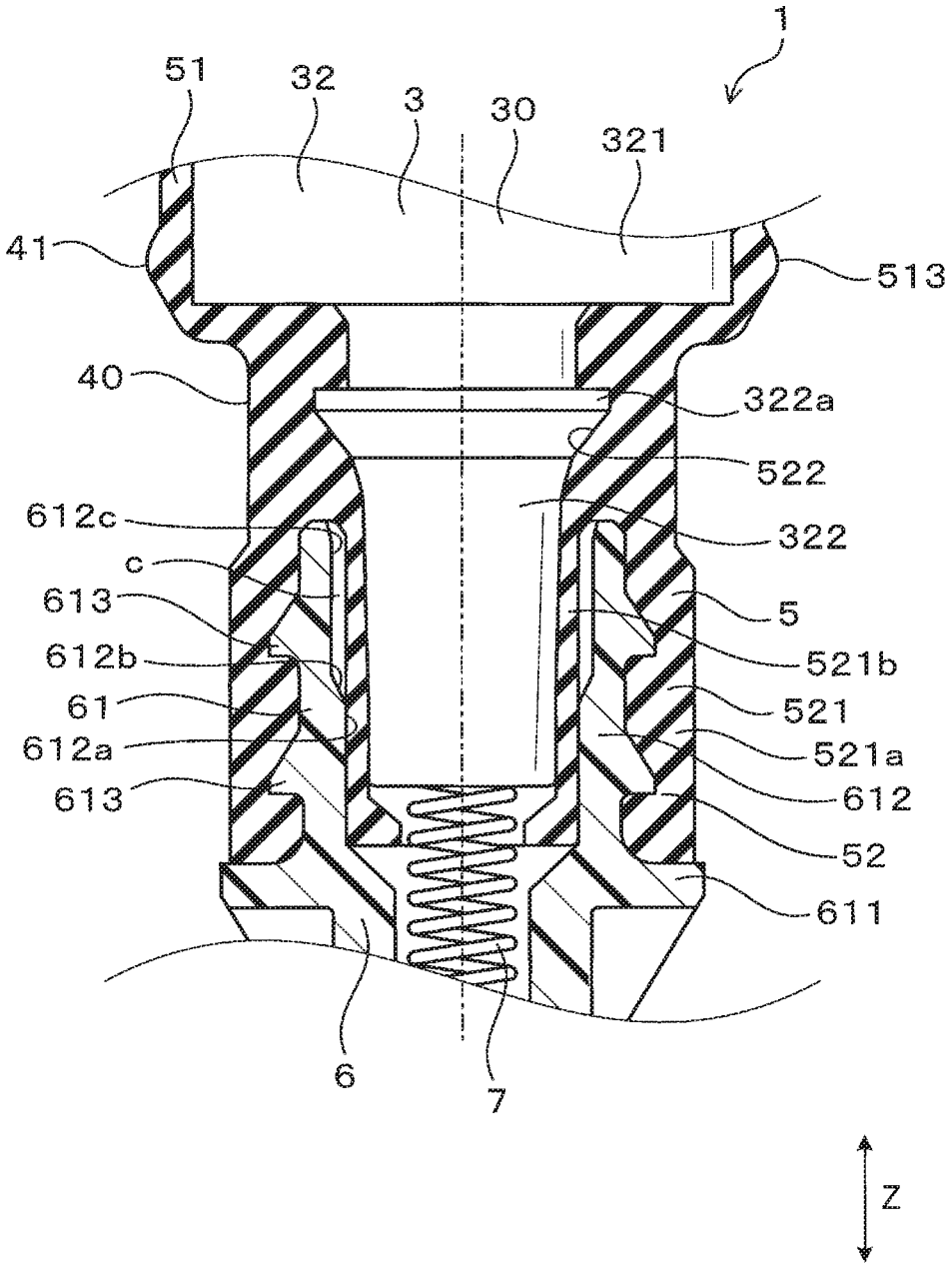
FIG. 2 is an enlarged view illustrating a neck portion and its surroundings illustrated in FIG. 1.

Further, as illustrated in FIGS. 1, 3 and 4, the sealing section 5 includes an adhesion portion 41 that tightly contacts the head cover 22. Also, as illustrated in FIGS. 1 to 3, the sealing section 5 includes a neck portion 40, in which an outer peripheral surface thereof is depressed toward an inner peripheral surface at least between the adhesion portion 41 and the joint 6 in the Z-axis direction. As described later with reference to another embodiment of the present disclosure, more than two adhesion portions 41 can be formed and employed. Specifically, in such a situation. the sealing section 5 includes the neck portion 40 at least between the adhesion portion 41 arranged on the topmost tip side and the joint 6 in Z-axis direction.

Herein below, the ignition coil unit 1 according to one embodiment of the present disclosure is described more in detail, wherein a direction, in which a central axis of the cylindrical high tension tower 32 extends is referred to as a Z-axis direction. A side, on which the joint 6 is located relative to the coil unit 3 in the axial direction Z is referred to as a tip side. An opposite side of the tip side is referred to as a base end side. Further, a radial direction of the high tension tower 32 is simply referred to as a radial direction. Further, in FIGS. 1 to 3, respective central axes of the high tension tower 32 and the joint 6 are represented by one dot chain lines.

As illustrated in FIG. 4, the ignition coil unit 1 of this embodiment of the present disclosure is connected to the spark plug installed in the plug hole 211 of the cylinder head 21 mounted on a car or a cogeneration and the like to apply a high voltage to the spark plug. That is, the ignition coil unit 1 is attached to the engine unit 20 by inserting the coupling unit 4 (i.e., the sealing section 5 and the joint 6) into both of the opening hole 221 of the head cover 22 and the plug hole 211 of the cylinder head 21.

Although not illustrated, the coil unit 3 includes primary and secondary coils magnetically coupled to each other. The coil unit 3 is configured to control the secondary coil to generate a high voltage to ignite the spark plug by either increasing or decreasing an amount of current flowing along the primary coil. The primary and secondary coils are housed in a main housing 31 of a housing unit 30.

The housing unit 30 as a whole (i.e. the main housing 31 and the high tension tower 32) is made of resin such as PBT (polybutylene terephthalate) resin, etc. The main housing 31 is a box including an opening facing the base end side (in the ignition coil unit 1).

Again, although not illustrated, the main housing 31 is filled with sealing resin such as epoxy resin, etc. Hence, various components placed in the main housing 31, such as the primary coil, the secondary coil, etc., are fixed by the sealing resin.

Further, as illustrated FIGS. 1 and 3, a connector 311 projecting perpendicular to the Z-axis direction is provided in the main housing 31. The connector 311 connects the ignition coil unit 1 with an external equipment such as an ECU (i.e., an engine control unit), etc., when one end of a cable (i.e., an external connector) connected to the external equipment at its another end is connected to the connector 311. Further, a high tension tower 32 is provided and projects from a tip side wall of the main housing 31 toward the tip side (in the ignition coil unit 1).

The high tension tower 32 is cylindrical having a through hole directed in the Z-axis direction. As illustrated in FIGS. 1 and 3, the high tension tower 32 includes a base end cylindrical portion 321 located on the base end side thereof and a tip cylindrical portion 322 formed on the tip side opposed to the base end cylindrical portion 321. The base end cylindrical portion 321 has an annular shape. An outer diameter of the base end cylindrical portion 321 is larger than that of the tip cylindrical portion 322.

The tip cylindrical portion 322 is formed from a center of the base end cylindrical portion 321 when viewed from the tip side in the Z-axis direction. As illustrated in FIG. 2, a retainer 322*a* radially projecting toward an outer peripheral surface of the sealing section 5 is formed and located in the tip cylindrical portion 322 in order to retain (i.e., prevent falling of) the sealing section 5. The retainer 322*a* increasingly projects radially to the outer peripheral surface of the sealing section 5 as it goes on to the base end side. The retainer 322*a* is formed over the entire circumference of the high tension tower 32. The retainer 322*a* lies on the base end a side of the joint 6 in the Z-axis direction. Further, the sealing section 5 is located to entirely cover the high tension tower 32 from the outer peripheral surface thereof.

Further, the sealing section 5 is made of rubber. As illustrated in FIG. 1, the sealing section 5 includes a base end sealing portion 51 fitting to the base end cylindrical portion 321 of the high tension tower 32. The sealing section 5 also includes a tip sealing portion 52 fitting to the tip cylinder section 322 as well.

Further, as illustrated in FIGS. 1 and 3, a base end of the based end sealing portion 51 includes a spreading portion 511 that outwardly spreads in the radial direction. As illustrated in FIG. 1, a base end of the expanding portion 511 tightly contacts a tip side surface of the main housing 31.

Further, as illustrated in FIGS. 1 and 3, the spreading portion 511 includes an extended portion 512 extended toward the tip side at an outer peripheral edge thereof. Hence, as illustrated in FIG. 4, the extended portion 512 tightly contacts the entire circumference of surroundings of the opening hole 221 of the head cover 22 when the ignition coil unit 1 is attached to the engine unit 20. With this, the spreading portion 511 seals a gap between the housing unit 30 and the head cover 22. That is, the extended portion 512 constitutes the adhesion portion 41 of the sealing section 5.

Further, as illustrated in FIGS. 1 to 3, a lip 513 projecting radially outside is formed at a tip of the base end sealing portion 51. The lip 513 is located to overlap with a tip section of the base end cylindrical portion 321 of the high tension tower 32 when assembled and viewed in the radial direction.

Hence, as illustrated in FIG. 4, when the ignition coil unit 1 is attached to the engine unit 20, the lip 513 tightly contacts the entire inner peripheral surface of the opening hole 221 of the head cover 22. Specifically, the lip 513 also constitutes the above-described adhesion portion 41 of the sealing section 5 similar to the extended portion 512. Further, the base end cylindrical portion 321 of the high tension tower 32 is pressed against the opening hole 221 of the cylinder head 21 in the radial direction through the lip 513. With this, the high tension tower 32 becomes coaxial with the opening hole 221. That is, a central axis of the high tension tower 32 is aligned with a central axis L2 of the opening hole 221 of the head cover 22. Thus, a region located on the tip side of the lip 513 in the sealing section 5 is equivalent to the tip sealing portion 52.

As illustrated in FIG. 4, when the ignition coil unit 1 is attached to the engine body 20, the tip sealing portion 52 of the sealing section 5 is partially located inside the plug hole 211 (in the Z-axis direction). Thus, a maximum diameter of a portion of the tip sealing portion 52 located inside the plug hole 211 is almost equivalent to a diameter of the plug hole 211, in which the tip sealing portion 52 is located (in the Z-axis direction).

Further, as illustrated in FIG. 2, the tip sealing portion 52 includes a recess 522 on its inner peripheral surface to accommodate the retainer 322*a* of the high tension tower 32. The recess 522 has a shape corresponding to an outline of the retainer 322*a*. Specifically, the recess 522 increasingly projects radially outside as it goes on to the base end side. The recess 522 is located on the base end side of the joint 6 in the Z-axis direction.

Further, as illustrated in FIG. 2, a neck portion 40 is formed at a position of the sealing section 5 at which the sealing section 5 overlaps with the recess 522 when viewed in the radial direction. With this, a region of the sealing section 5, in which both of the neck portion 40 and the recess 522 are formed (in the Z-axis direction) is formed thinner than both of upper and lower adjacent regions thereof in the Z-axis direction.

As illustrated in FIG. 2, a diameter of the neck portion 40 is smaller than that of surroundings of the neck portion 40 in the sealing section 5. In addition, an outer diameter of the neck portion 40 is smaller than that of the outer peripheral of the below described projection 613 of the joint 6. Further, in this embodiment of the present disclosure, an outer diameter of the neck portion 40 is smaller than that of the whole area of the sealing section 5 located on the tip side of the neck portion 40. Especially, in this embodiment of the present disclosure, the outer diameter of the neck portion 40 is smallest in the sealing section 5.

As illustrated in FIG. 2, the neck portion 40 is continuously formed in the Z-axis direction from a tip of the lip 513 to a position slightly on a tip side relative to a base end of the joint 6. That is, a tip of the neck portion 40 overlaps with the joint 6 in the radial direction. The neck portion 40 has a prescribed length in the Z-axis direction. As illustrated in FIG. 2, the neck portion 40 is continuously formed in the Z-axis direction from a tip position of the lip 513 to a position slightly on the tip side relative to the base end of the joint 6. That is, a tip of the neck portion 40 overlaps with the joint 6 in the radial direction. That is, in this embodiment of the present disclosure, the neck portion 40 is not locally formed in the Z-axis direction, but has the prescribed length in the Z-axis direction in order to ease absorption of the axial misalignment generated between the high tension tower 32 and the joint 6. Also, the neck portion 40 extends continuously over a perimeter of the sealing section 5.

Further, as illustrated in FIGS. 1 to 3, a tip fitting portion 521 is formed at a tip of the sealing section 5, to which the joint fitting section 61 of the joint 6 fits. That is, the joint fitting section 61 is inserted and fits into the tip fitting portion 521.

Further, as illustrated in FIG. 2, the tip fitting portion 521 includes an outer peripheral fitting portion 521*a* that covers the joint fitting section 61 from an outer periphery and an inner peripheral fitting portion 521*b* that covers the joint fitting section 61 from an inner periphery. A tip surface of the outer peripheral fitting portion 521*a* contacts a ring 611 included in the joint 6 as shown. The ring 611 projects radially outside as described later more in detail. However, the outer peripheral fitting portion 521*a* may not contact the ring 611. The inner peripheral fitting portion 521*b* almost extends along the outer peripheral surface of the high tension tower 32.

Here, the joint 6 is made of PPS (i.e., polyphenylene sulfide resin) and is harder than the sealing section 5 made of rubber. As illustrated in FIG. 2, the joint fitting portion 61 includes the ring 611 that contacts the tip surface of the outer peripheral fitting portion 521*a* and a cylindrical insert portion 612 formed inside the tip fitting portion 521 on the base end side of the ring 611.

As illustrated in FIG. 4, when the ignition coil unit 1 is attached to the engine unit 20, an outer diameter of the ring 611 is almost equivalent to that of the plug hole 211.

Further, as illustrated in FIG. 2, the insert portion 612 includes two (cylindrical) projections 613 extending radially outside at two respective positions in the Z-axis direction. Each of the projections 613 increasingly extends radially outside as it goes on to the tip side. Each of the projections 613 functions to prevent the joint 6 from dropping from the tip fitting portion 521 of the sealing section 5.

As illustrated in FIG. 2, on an inner peripheral surface of the insert portion 612, a tip inner peripheral surface 612*a*, an inner peripheral step 612*b*, and a base end inner peripheral surface 612*c* are formed in this order from the tip side. The tip inner peripheral surface 612*a* is cylindrical and extends linearly in the Z-axis direction. The inner peripheral step 612*b* is extended from an end of the tip inner peripheral surface 612*a* to the base end side. The inner peripheral step 612*b* is increasingly inclined radially outside as it goes on to the base end side in the Z-axis direction. The base end inner peripheral surface 612*c* is extended from an end of the inner peripheral step 612*b* to the base end side in the Z-axis direction. The inner peripheral step 612*b* is positioned substantially at a center of the insert portion 612 in the Z-axis direction.

Further, a cavity c is formed between each of the inner peripheral step 612*b* and the base end inner peripheral surface 612*c* and the inner peripheral fitting portion 521*b* of the seal section 5 in the radial direction. In this embodiment of the present disclosure, an outer peripheral surface of the inner peripheral fitting portion 521*b* of the sealing section 5 is almost extended along the Z-axis direction. Hence, a tip of the inner peripheral fitting portion 521*b* tightly contacts the tip inner peripheral surface 612*a*. On the other hand, a portion on the base end side of the inner peripheral fitting portion 521*b* forms the cavity c with each of the inner peripheral step 612*b* and the base end inner peripheral surface 612*c* therebetween. A length of the cavity c in the Z-axis direction is about half of the insert portion 612.

Although it is not illustrated, a high voltage terminal is press fitted into a base end of the through hole of the high tension tower 32. The high-voltage terminal is connected to a high voltage side of the secondary coil and functions as an output terminal of the coil unit 3. The high-voltage terminal seals the through hole of the high tension tower 32 and also function as a plug not to allow the sealing resin filled in the main housing 31 to leak from the high tension tower 32.

Further, as illustrated in FIGS. 1 and 2, an elastically conductive coil spring 7 deformable in the Z-axis direction is located inside the joint 6 and the high tension tower 32. The coil spring 7 elastically contacts a high-voltage terminal located inside the high tension tower 32. Although it is not illustrated, the coil spring 7 is positioned with regard to the joint 6 in the Z axial direction.

Further, as illustrated in FIG. 1, the coupling unit 4 includes a plug cap 8 made of rubber fitting to the tip of the joint 6. The spark plug is fit into the tip side of the plug cap 8.

Now, an ignition system 2 including the ignition coil unit used in an internal combustion engine according, to another embodiment of the present disclosure is described with reference to FIG. 4.

The ignition system 2 of this embodiment comprises the ignition coil unit 1 and the engine unit 20 with the cylinder head 21 and the head cover. The cylinder head 21 includes the plug hole 211. The head cover 22 covers the cylinder head 21 and includes the opening hole 221 facing the plug hole 211. The ignition coil unit 1 is inserted into the plug hole 211 and the opening hole 221 as well.

In general, the head cover 22 and the cylinder head 21 are designed such that a central axis L2 of the opening hole 221 of the head cover 22 aligns with a central axis L1 of the plug hole 211 of the cylinder head 21. However, due to assembly tolerance of the cylinder head 21 and the head cover 22 and dimensional tolerances of the cylinder head 21 and the head cover 22, etc., the cylinder head 21 and the head cover 22 are manufactured sometimes to cause misalignment between the central axes of the plug hole 211 and the opening hole 221. Hence, this embodiment is described based on the ignition unit 2 when the plug hole 211 of the cylinder head 21 and the opening hole 221 of the head cover 22 misalign with each other.

Herein below, a direction of axial misalignment between the plug hole 211 and the opening hole 221 of the head cover 22 when viewed from the Z-axis direction is herein below referred to as a direction X. In the direction X, a side on which the central axis L2 of the head cover 22 is located relative to the central axis L1 of the plug hole 211 is herein below referred to as a X1 side. Further, an outline of the ignition coil unit 1 is illustrated by a two-dot chain line when the central axis L2 of the opening hole 221 of the head cover 22 aligns with the central axis L1 of the plug hole 211.

Specifically, the plug hole 211 of the cylinder head 21 on the base end side is opened. Although not illustrated, a female screw hole is provided and formed at the tip of the plug hole 211. The spark plug is screwed to the female hole and is attached to the plug hole 211.

Further, the opening hole 221 formed in the head cover 22 is slightly larger by one size than that of the plug hole 211. At a site adjacent to the opening hole 221 of the head cover 22, a positioning portion 222 is formed as a projection on the base end side in the Z-axis direction. The positioning portion 222 (i.e., the projection) is composed of a ring extended over the entire circumference of the opening hole 221.

Further, the ignition coil unit 1 is inserted into the opening hole 221 of the head cover 22 and the plug hole 211 as well. More specifically, the ignition coil unit 1 is inserted into the opening hole 221 of the cover 22 and the plug hole 211 with the extended portion 512 of the sealing section 5 almost covering the positioning portion 222 both in the X and D directions.

Further, a lip 513 included in the sealing section 5 of the ignition coil unit 1 pressure contacts an inner peripheral surface of the opening hole 221 of the head cover 22. With this, the base end cylindrical portion 321 of the high tension tower 32 can pressure contact the head cover 22 via the lip 513. At the same time, the central axis of the high tension tower 32 can be aligned with the central axis L2 of the opening hole 221 of the head cover 22.

Further, the neck portion 40 is partially located inside an opening end 211*a* of the plug hole 211. Specifically, the neck portion 40 is positioned to partially overlap with the opening end 211*a* of the plug hole 211 in the radial direction. In this embodiment of the present disclosure, a recess 522 to receive a retainer 322*a* that retains the high tension tower 32 is formed on the inner peripheral surface of the seal section 5 and located on the base end side of the plug hole 211.

Accordingly, in this embodiment of the present disclosure, due to the axial misalignment between the plug hole 211 and the opening hole 221, a region between the lip 513 and the tip fitting portion 521 of the seal section 5 increasingly inclines to the X1 side as it goes on to the base end side. With this, when it is compared with a situation in which the central axes of the plug hole 211 and the opening hole 221 are aligned with each other (i.e., a condition shown in FIG. 4 by the two-dot chain line), a portion of the seal section 5 on the X1 side approaches the opening of the plug hole 211 on the base end side. However, since the neck portion 40 is located facing the inner peripheral surface of the opening end 211*a* of the plug hole 211 on the base end side, the sealing section 5 is prevented from contacting the opening of the plug hole 211 on the base end side.

Now, an advantage obtained in one embodiment of the present disclosure is described herein below. In the ignition coil unit 1 of one embodiment of the present disclosure, the sealing section 5 includes an adhesion portion 41 that tightly contacts the head cover 22. Further, a joint 6 harder than the sealing section 5 is located in the tip fitting portion 521 of the sealing section 5. Hence, the ignition coil unit 1 attached to the engine unit 20, in which axial misalignment occurs between the opening hole 221 of the head cover 22 and the plug hole 211 can accordingly generate axial misalignment between the high tension tower 32 and the joint 6. Because, the high tension tower 32 is guided by the opening hole 221 of the head cover 22 via the adhesion portion 41 of the sealing section 5 fitting to the opening hole 221. With this, the central axis of the high tension tower 32 is adjusted to align with the central axis L2 of the opening hole 221 of the head cover 22. Further, the joint 6 located in the plug hole 211 is guided by the plug hole 211. With this, a central axis of the joint 6 is aligned with a central axis L1 of the plug hole 211. As a result, the high tension tower 32 and the joint 6 collectively generate the axial misalignment. As a result, due to the axial misalignment between the high tension tower 32 and the joint 6, a region between the adhesion portion 41 and the joint 6 deforms in the sealing section 5.

In view of this, according, to this embodiment of the present disclosure, the sealing section 5 includes the neck portion 40, in which at least an outer surface is depressed in a region between the adhesion portion 41 and the joint 6 in the Z-axis direction. That is, as described earlier, the neck portion 40 is provided in a portion of the sealing section 5 deformed by the axial misalignment between the opening hole 221 of the head cover 22 and plug hole 211. Hence, even if the axial misalignment occurs between the opening hole 221 of the head cover 22 and the plug hole 211, the sealing section 5 can be avoided from interfering with the opening end 211*a* of the plug hole 211.

Figure 5:
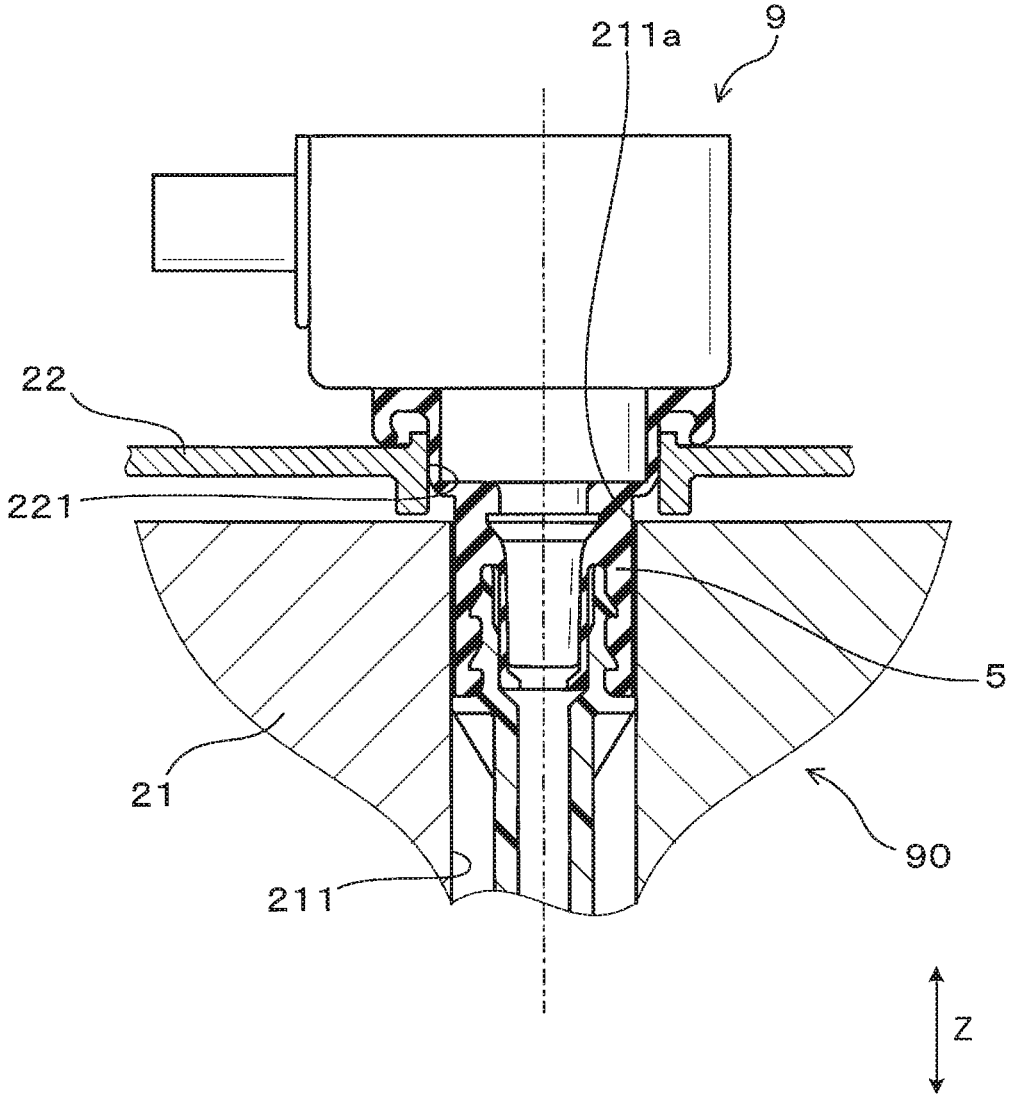
FIG. 5 is a partially sectional front view illustrating an ignition system of a comparative example of the present disclosure, in which an opening hole of a head cover is coaxial with a plug hole.
Figure 6:
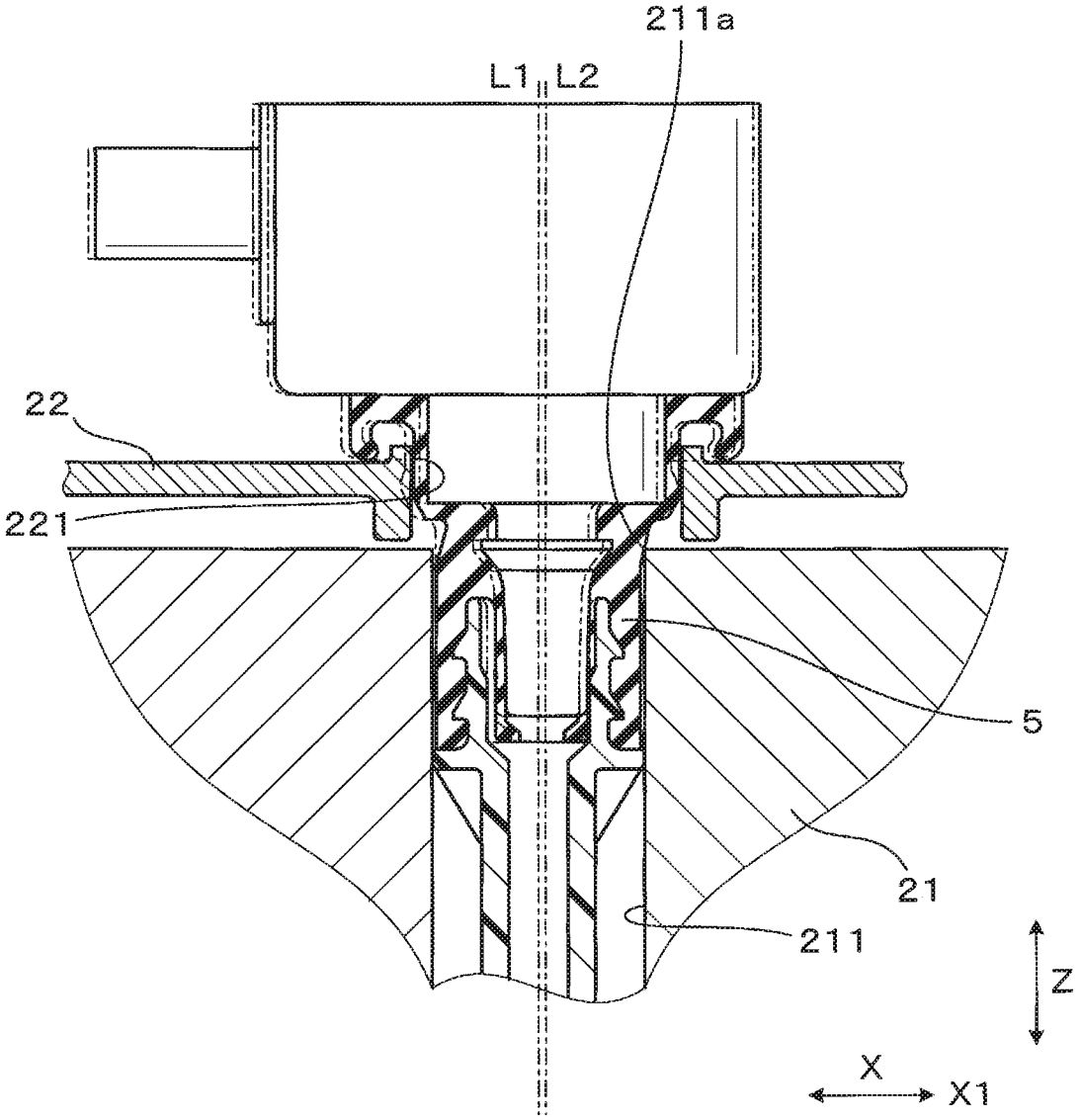
FIG. 6 is also a partially sectional front view illustrating an ignition system of a comparative example of the present disclosure, in which the opening hole of the head cover misaligned with the plug hole.

Here, an ignition system 90 with an ignition coil unit 9 excluding the neck portion is described with reference to FIGS. 5 and 6 as a comparative example. As shown, the comparative example includes the similar configuration to one embodiment of the present disclosure except that the ignition coil unit 9 thereof excludes the neck portion. As illustrated in FIG. 5, in the ignition system 90 of the comparative example, when the axial misalignment is not generated between the opening hole 221 of the head cover 22 and the plug hole 211, the sealing section 5 does not pressure contact the opening end 211*a* of the plug hole 211 on the base end side. By contrast however, as illustrated in FIG. 6, in the ignition system 90 of the comparative example, when the central axis L2 of the opening hole 221 of the head cover 22 is located on the X1 side thereby misaligning with the central axis L1 of the plug 211, a portion of the sealing section 5 on the X1 side pressure contacts the opening end 211*a* of the plug hole 211 on the base end side. With this, the sealing section 5 cannot be durable.

By contrast, as illustrated in FIG. 4, since the sealing section 5 of this embodiment of the present disclosure includes the neck portion 40, the sealing section 5 can be avoided from interfering with the opening end 211*a* of the plug hole 211.

Further, the neck portion 40 is located at a position to overlap with the recess 522 in the radial direction. Hence, a portion of the sealing section 5, in which both of the neck portion 40 and the recess 522 are formed is thinner than both sides thereof located in the Z-axis direction. As a result, the sealing section 5 can easily secure flexibility in the neck portion 40. Hence, when the ignition coil unit 1 is inserted into the engine unit 20, in which axial misalignment occurs between the opening hole 221 of the head cover 22 and the plug hole 211, since the neck portion 40 of the ignition coil unit 1 deforms in accordance with the axial misalignment between the opening hole 221 of the head cover 22 and the plug hole 211, the ignition coil unit 1 can be easily and safely inserted into and located at the engine unit 20.

Further, since it has a given length in the Z-axis direction, the neck portion 40 can be readily located radially inside the opening end 211*a* of the plug hole 211 on the base end side when the ignition coil unit 1 is attached to the engine unit 20. As a result, productivity of the ignition coil unit 1 can effectively be enhanced.

In addition, since the neck portion 40 provides a minimum diameter of the sealing section 5, an outer peripheral surface of the neck portion 40 is more deeply depressed to the inner peripheral side in the sealing section 5. With this, interference between the neck portion 40 and the opening end 211*a* of the plug hole 211 can be more effectively prevented. Further, as the outer diameter of it becomes smaller, a thickness of the neck portion 40 can be easily thinned. Accordingly, flexibility of the neck portion 40 can be secured. Hence, when the ignition coil unit 1 is inserted into the engine unit 20, in which axial misalignment occurs between the opening hole 221 of the head cover 22 and the plug hole 211, since the neck portion 40 of the ignition coil unit 1 deforms in accordance with the axial misalignment between the opening hole 221 of the head cover 22 and the plug hole 211, the ignition coil unit 1 can be easily and safely inserted into and located ultimately in the engine unit 20.

Further, the cavity c is formed in the radial direction between each of the base end inner peripheral surface 612*c* and the inner peripheral step 612 provided in the joint fitting section 61 and the sealing section 5. Hence, the flexibility in the radial direction of the joint fitting section 61 and its surroundings in the sealing section 5 may be increased. Accordingly, when the ignition coil unit 1 is inserted into the engine unit 20, in which axial misalignment occurs between the opening hole 221 of the head cover 22 and the plug hole 211, the joint fitting section 61 and its surroundings in the sealing section 5 can readily deform in accordance with the axial misalignment. As a result, an ignition coil unit 1 easily and safely attached to an engine unit 20 generating axial misalignment between the opening hole 211 of the head cover 22 and the plug hole 211 can be obtained.

Further, according, to another embodiment of the present disclosure, the neck portion formed in the coupling unit 4 of the ignition sys 2 is at least partially located radially inside the opening end 211*a* of the plug hole 211 on the base end side. Hence, even when the axial misalignment occurs between the opening hole 221 of the head cover 22 and the plug hole 211, the coupling unit 4 can be prevented from interfering with the opening end 211*a* of the plug hole 211.

As described heretofore, according to one embodiment of the present disclosure, the ignition coil unit and the ignition system used in the internal combustion engine capable of either avoiding or reducing interference with the opening end of the plug hole can be obtained.

Figure 7:
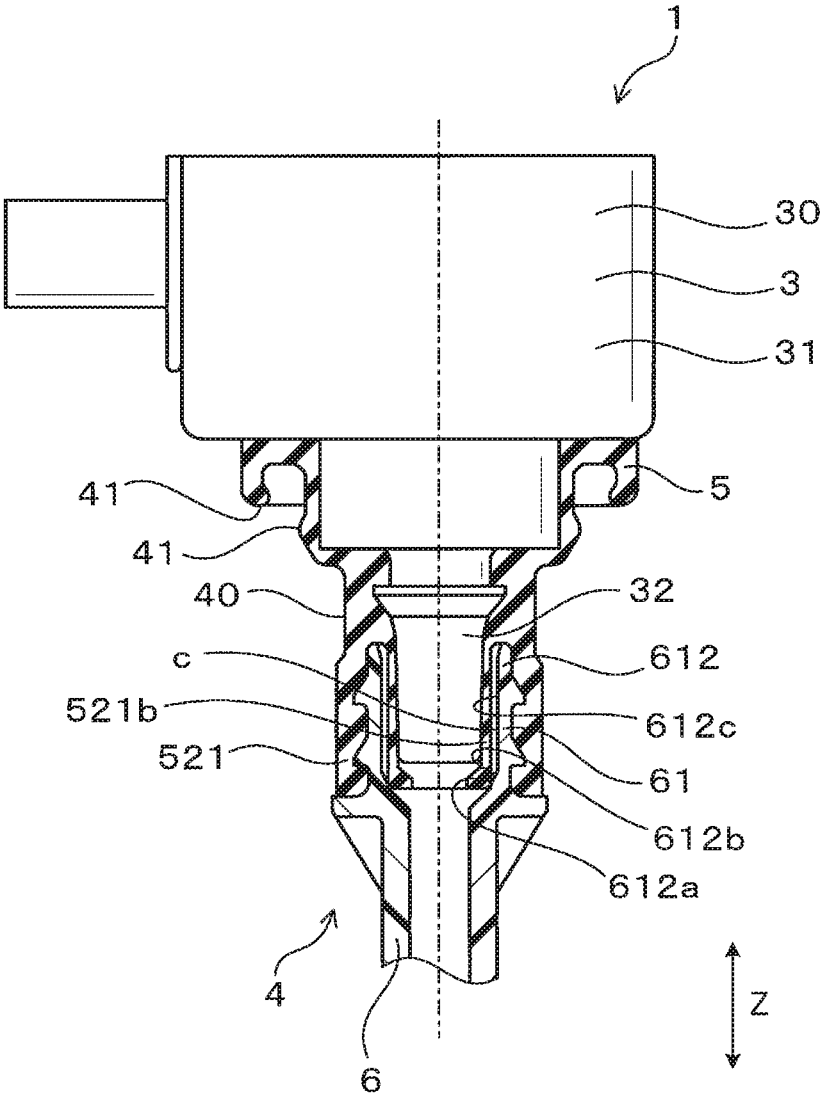
FIG. 7 is a partially sectional front view illustrating an ignition coil unit according to a second embodiment of the present disclosure.

Now, a second embodiment of the present disclosure is described herein below with reference to FIG. 7. As illustrated in FIG. 7, the second embodiment of the present disclosure is a modification of the first embodiment of the present disclosure and is obtained by changing a shape of the joint fitting section 61 of the first embodiment.

In this embodiment of the present disclosure, the inner peripheral step 612*b* formed on the inner peripheral surface of the insert portion 612 of joint fitting section 61 is located at the tip side in the insert portion 612. With this, the base end inner peripheral surface 612*c* of the joint fitting section 61 is longer than the tip inner peripheral surface 612*a* in Z-axis direction.

In addition, the inner peripheral fitting portion 521*b* of the tip fitting portion 521 of the sealing section 5 tightly contacts the tip inner peripheral surface 612*a*, while forming the cavity c with each of the inner peripheral step 612*b* and the base end inner peripheral surface 612*c*. With this, the cavity c is longer than half of the insert portion 612 in the Z-axis direction.

The remaining sections and portions are substantially the same as those of the first embodiment of the present disclosure.

Accordingly, according, to this embodiment of the present disclosure, flexibility in the radial direction of the joint fitting section 61 and surroundings thereof in the sealing section 5 is further enhanced. Hence, when the ignition coil unit 1 is inserted into the engine body, in which axial misalignment occurs between the opening hole of the head cover and the plug hole, the joint fitting section 61 and surroundings thereof in the sealing section 5 can effectively deform in accordance with the axial misalignment. With this, an ignition coil unit 1 more easily attached to the engine unit 20 generating axial misalignment between the opening hole of the head cover and the plug hole can be readily obtained. Besides, the second embodiment of the present disclosure can obtain a similar advantage to that of the first embodiment of the present disclosure.

Figure 8:
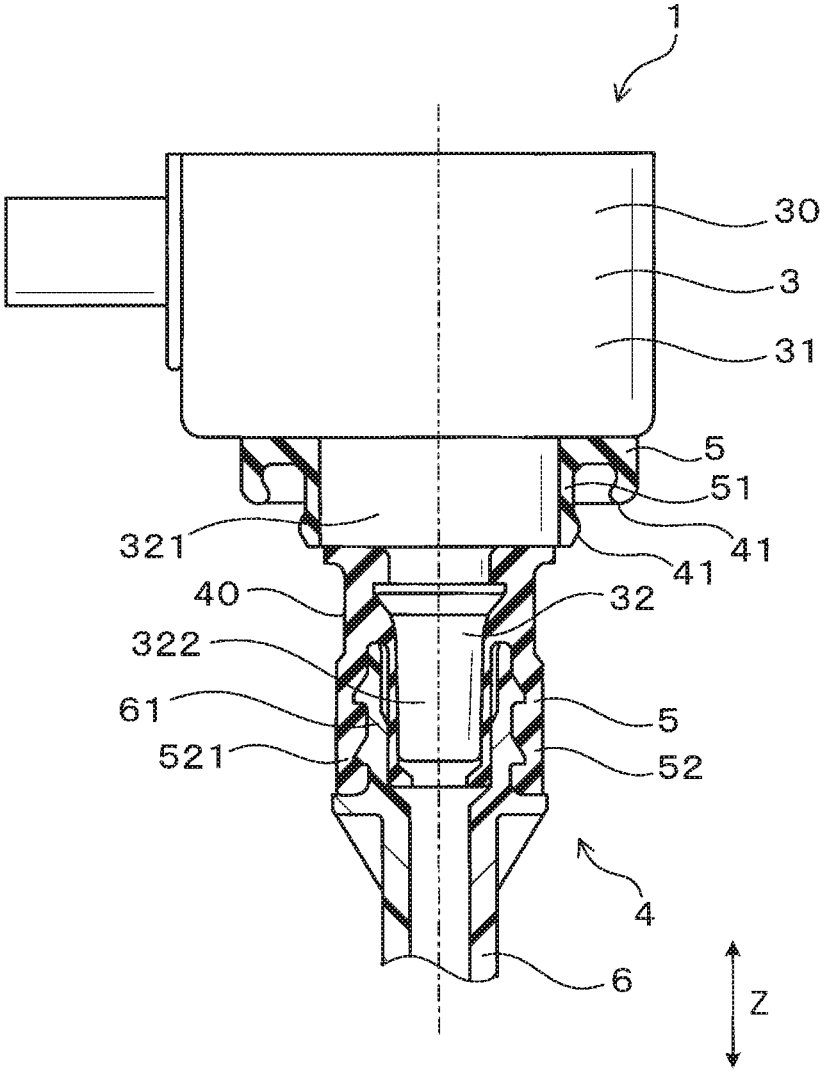
FIG. 8 is a partially sectional front view illustrating an ignition coil unit according to a third embodiment of the present disclosure.

Now, a third embodiment of the present disclosure is herein below described with reference to FIG. 8. As illustrated, in this embodiment of the present disclosure, a sealing section 5 is composed of multiple members. That is, in this embodiment of the present disclosure, the sealing section 5 is configured by including a (cylindrical) base end sealing portion 51 to cover the base end cylindrical portion 321 of the high tension tower 32 and a (cylindrical) tip sealing portion 52 separately prepared from the base end sealing portion 51 to cover the tip cylindrical portion 322 of the high tension tower 32.

More specifically, the neck portion 40 is formed in a base end of the base end sealing portion 51 (the tip sealing portion 52). That is, upper and lower portions of the base end sealing portion 51 (the tip sealing portion 52) sandwiching the neck portion 40 in the Z-axis direction projects radially outside from the neck portion 40.

Remaining configurations are similar to those of the first embodiment of the present disclosure and are not repeatedly described. Again, the third embodiment of the present disclosure can obtain a similar advantage as the first embodiment of the present disclosure.

Figure 9:
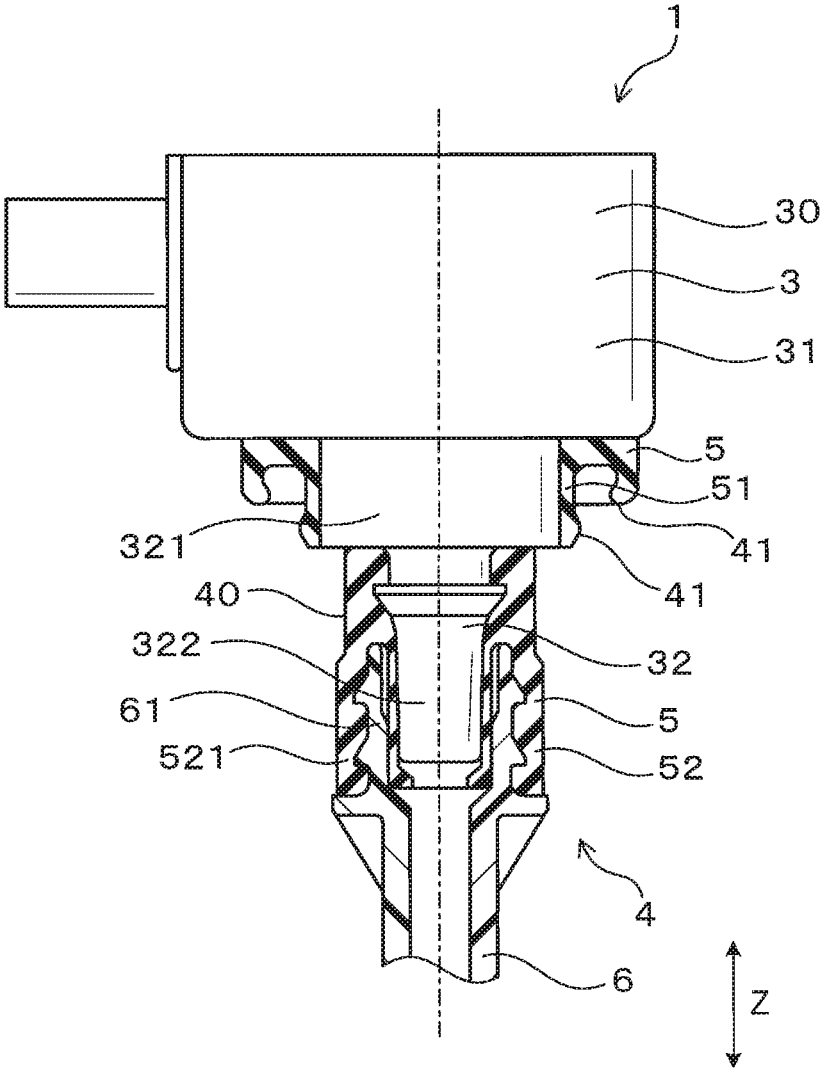
FIG. 9 is a partially sectional front view illustrating an ignition coil unit according to a fourth embodiment of the present disclosure.

Now, a fourth embodiment of the present disclosure is herein below described with reference to FIG. 9. As illustrated in FIG. 9, this embodiment of the present disclosure is a modification of the third embodiment and changes a shape of the tip sealing portion 52 employed in the third embodiment. That is, in this embodiment of the present disclosure, the neck portion 40 extends up to a base end of the tip sealing portion 52. Remaining configurations are similar to those of the third embodiment of the present disclosure and description thereof will be not repeated. Hence, the fourth embodiment of the present disclosure can again obtain a similar advantage as the third embodiment of the present disclosure.

Figure 10:
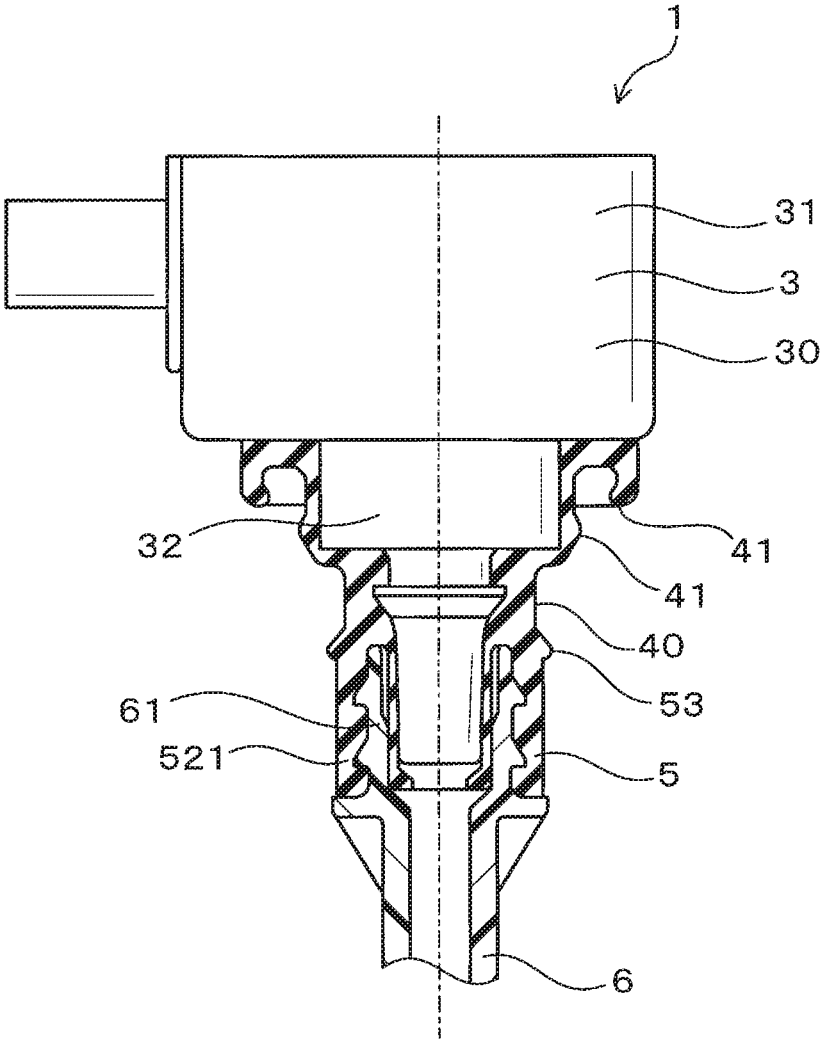
FIG. 10 is a partially sectional front view illustrating an ignition coil unit according to a fifth embodiment of the present disclosure.
Figure 11:
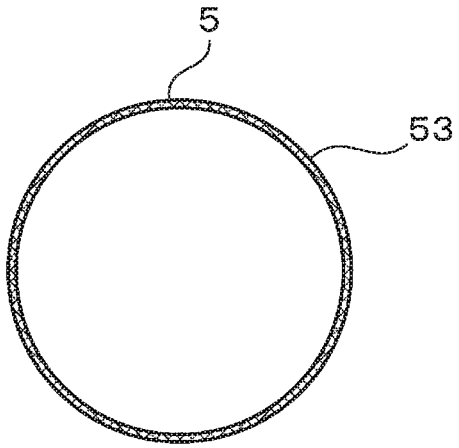
FIG. 11 is a horizontal cross-sectional view illustrating a convex portion formed perpendicular to the central axis in the fifth embodiment of the present disclosure.
Figure 12:
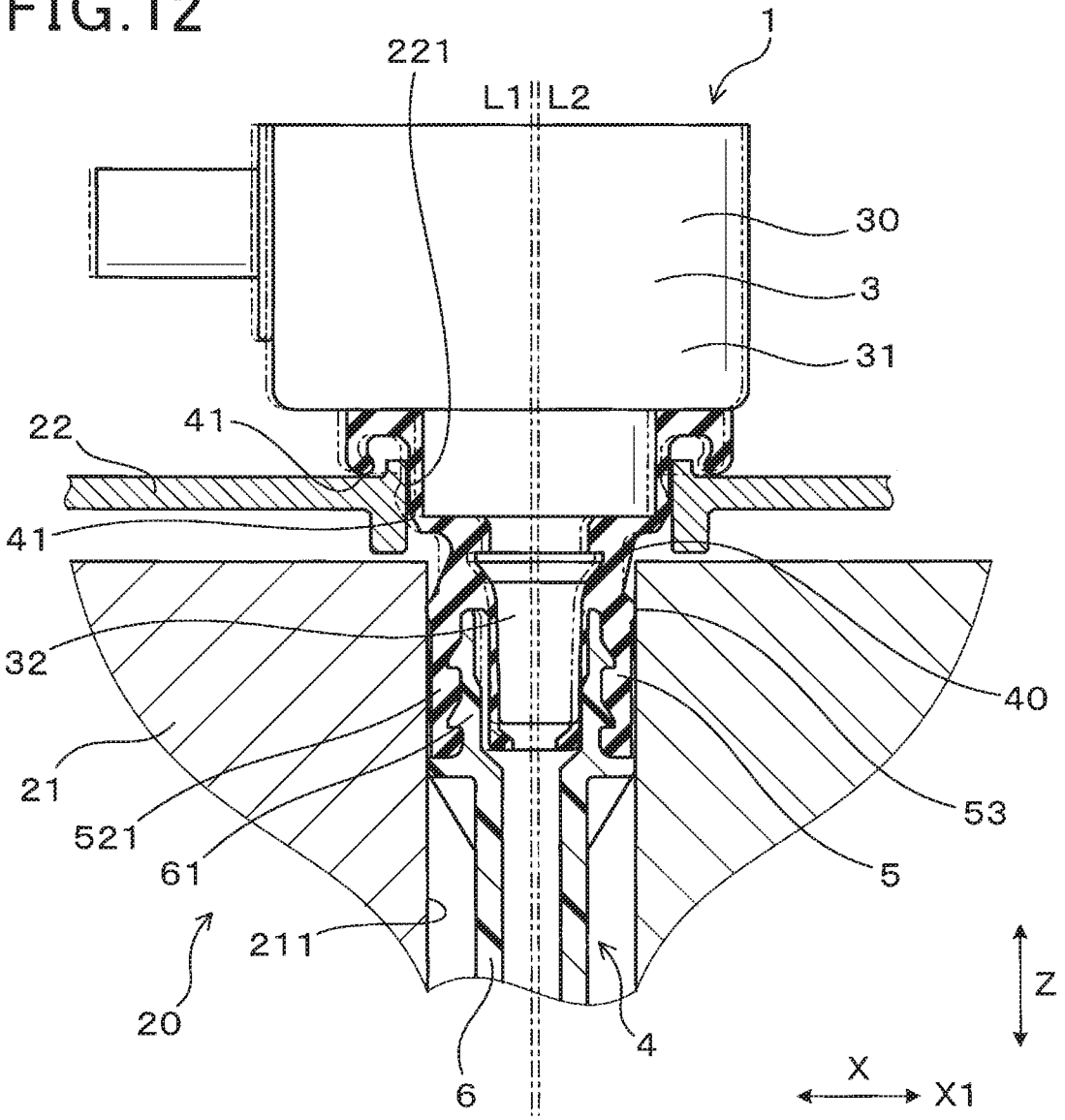
FIG. 12 is a partially sectional front view illustrating an ignition coil unit composed of the ignition coil unit of the fifth embodiment of the present disclosure.

Now, a fifth embodiment of the present disclosure is herein below described with reference to FIGS. 10 to 12. As illustrated in FIGS. 10 to 12, a basic structure of this embodiment of the present disclosure is substantially the same as the first embodiment of the present disclosure. However, the sealing section 5 includes a convex portion 53 extending outside radially from an outer peripheral surface of the sealing section 5 at a position neighboring the neck portion 40 on the tip side. That is, as illustrated in FIG. 10, the convex portion 53 extends radially outside from both sides of the sealing section 5 extending in the Z-axis direction. More specifically, in a cross section of the ignition coil unit 1 including the central axis of the high tension tower 32 (i.e., parallel to the Z-axis direction), the convex portion 53 has almost an arc shape spreading radially outside.

Figure 13:
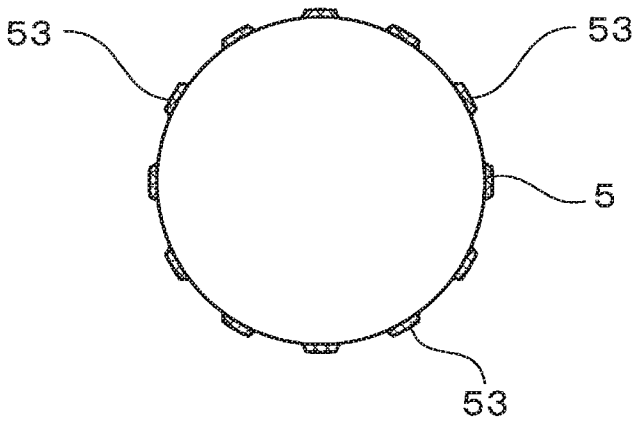
FIG. 13 is a cross-sectional view illustrating a modification of a convex portion formed in the ignition coil unit of the fifth embodiment of the present disclosure.

Further, as illustrated in FIG. 11, the convex portion 53 is continuously formed over the perimeter of the sealing section 5. However, as illustrated in FIG. 13, the convex portion 53 can be formed intermittently over the perimeter of the sealing section 5 as well. Here, illustration of the rest of the convex portion 53 is omitted in FIGS. 11 and 13. Again, remaining configurations are similar to those of the first embodiment of the present disclosure and are not repeated.

Hence, according, to this embodiment of the present disclosure, the sealing section 5 includes the convex portion 53 on its outer peripheral surface adjacent to the neck portion 40 on the tip side relative to the neck portion 40. With this, the neck portion 40 is relatively depressed to a certain degree from the convex portion 53. Thus, when the ignition coil unit 1 of this embodiment of the present disclosure is attached to the engine unit 20 generating axial misalignment between the opening hole 221 of the head cover 22 and the plug hole 211 as illustrated in FIG. 12, the convex portion 53 contacts the inner peripheral face of the plug hole 211. Thus, the neck portion 40 deeply depressed inside radially from the convex portion 53 can be further effectively prevented from interfering with the opening end 211*a* of the plug hole 211. Again, remaining configurations are similar to those of the first embodiment of the present disclosure and are not repeatedly described.

Figure 14:
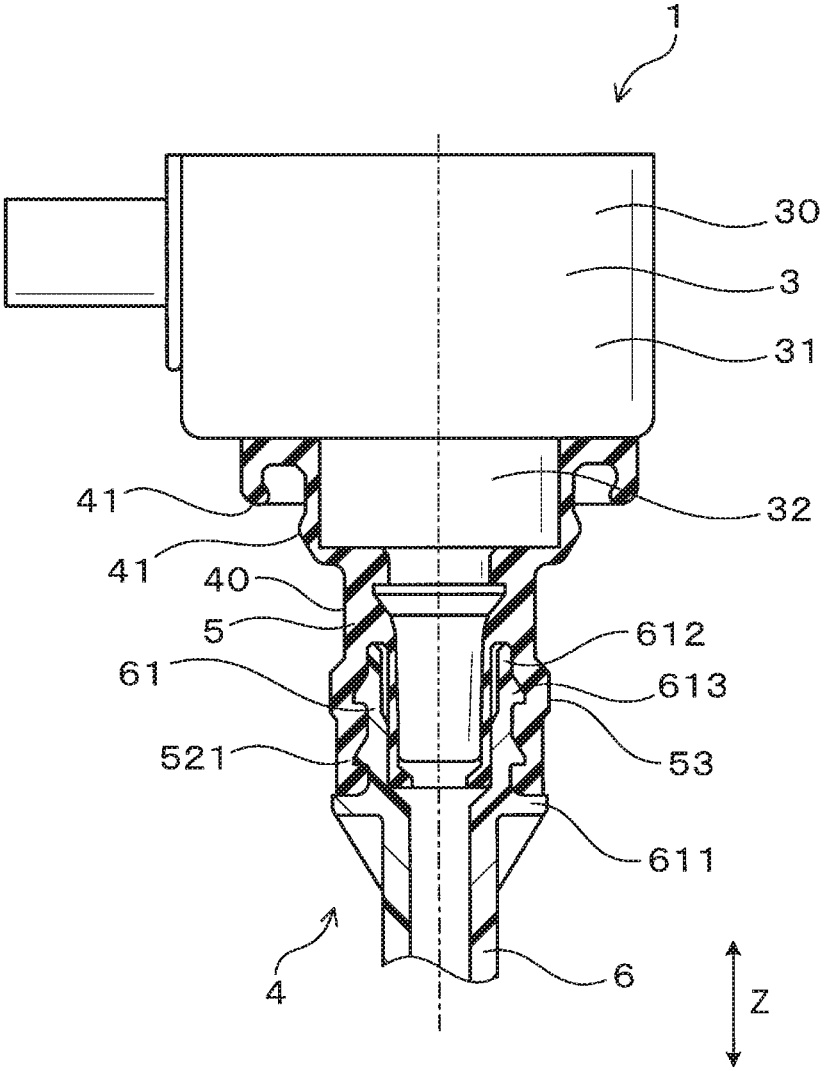
FIG. 14 is a partially sectional front view illustrating an ignition coil unit according to a sixth embodiment of the present disclosure.

Now, a sixth embodiment of the present disclosure is herein below described with reference to FIG. 14. As illustrated in FIG. 14, this embodiment of the present disclosure is a modification of the fifth embodiment of the present disclosure, and is prepared by changing a configuration of the convex portion 53 of the fifth embodiment. In this embodiment of the present disclosure, the convex portion 53 includes a given length in the Z-axis direction. Further, the convex portion 53 is formed at a position (e.g., a height) to overlap with the joint fitting section 61 of the joint 6 in the radial direction. More specifically, in this embodiment of the present disclosure, the convex portion 53 is placed at the position to overlap in the radial direction with the projection 613 formed in the insert portion 612 of the joint fitting section 61 on the base end side. The rest of the above-described configuration is substantially the same as that of the fifth embodiment of the present disclosure, and is not repeatedly described.

Hence, according, to this embodiment of the present disclosure, the convex portion 53 is formed at the position to overlap with the joint fitting section 61 in the radial direction. Accordingly, the joint 6 can easily be prevented from dropping from the tip fitting portion 521 of the sealing section 5. This embodiment of the present disclosure can provide substantially the same advantage other than the above-described advantage as the fifth embodiment of the present disclosure.

Figure 15:
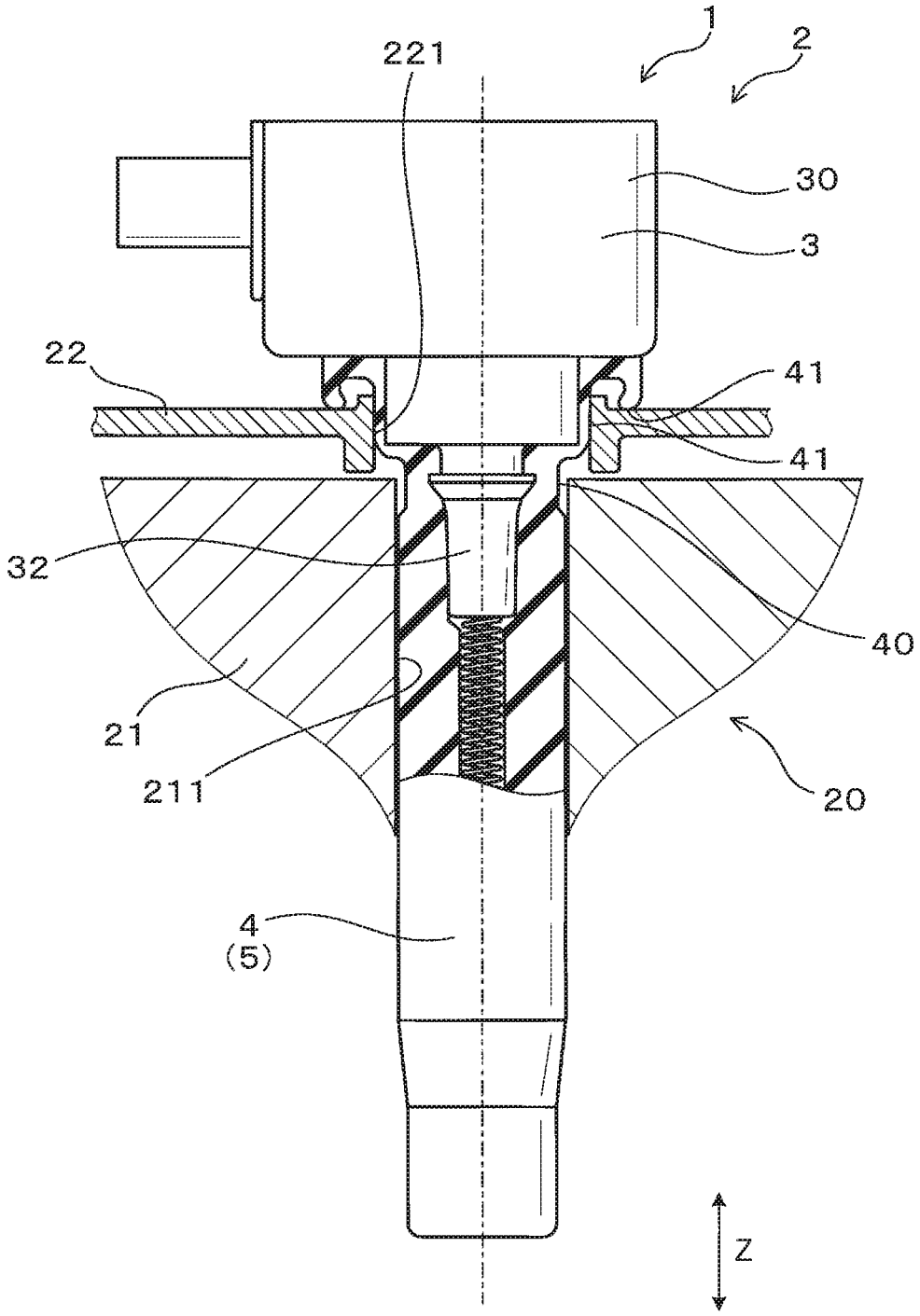
FIG. 15 is a partially sectional front view illustrating an ignition coil unit according to a seventh embodiment of the present disclosure.

Now, a seventh embodiment of the present disclosure is herein below described with reference to FIG. 15. As illustrated in FIG. 15, this embodiment of the present disclosure is a modification of the first embodiments of the present disclosure, and is prepared by changing a configuration of the coupling unit 4 of the first embodiment. That is, in this embodiment of the present disclosure, the coupling unit 4 is entirely constituted by the sealing section 5. More specifically, the base end of the sealing section 5 fits to the high tension tower 32 and the tip side thereof receives insertion of the spark plug.

The rest of the above-described configuration is substantially the same as that of the first embodiment of the present disclosure, and is not repeatedly described. This embodiment of the present disclosure can provide substantially the same advantage other than the above-described advantage as the first embodiment of the present disclosure.

The present disclosure is not limited to the above-described embodiments. For example, the neck portion 40 employed in each of the above-described embodiments can slope up to a middle portion thereof in the Z-axis direction by increasingly reducing a diameter of the neck portion 40 gradually in the direction X as it goes on to the middle portion thereof in the Z-axis direction. Further, the outer peripheral surface of the coupling unit 4 may be depressed stepwise by one step to exclude a slope therefrom in the Z-axis direction.

Numerous additional modifications and variations of the present disclosure are possible in light of the above teachings. It is Hence to be understood that within the scope of the appended claims, the present disclosure may be executed otherwise than as specifically described herein. For example, the ignition coil unit is not limited to the above-described various embodiments and may be altered as appropriate. Similarly, the ignition system is not limited to the above-described various embodiments and may be altered as appropriate.

What is claimed is:

1. An ignition coil unit used in an internal combustion engine as an attachment to an engine body that includes a cylinder head having a plug hole and a head cover that covers the cylinder head by including an opening hole facing the plug hole, the ignition coil unit comprising:
- a coil unit to generate a high voltage, the coil unit including;
  - a main housing to accommodate components used in the coil unit, and
  - an auxiliary housing to accommodate a cylindrical high tension tower protruding from the main housing to a tip side in an axial direction; and
- a cylindrical coupling unit to couple the coil unit to a spark plug,
- the cylindrical coupling unit including;
  - a flexible sealing section extending in an axial direction of the cylindrical coupling unit while fitting to an outer peripheral surface of the high tension tower,
  - the flexible sealing section including:
    - a first fitting section at a tip of the flexible sealing section, and
    - an adhesion portion to tightly contact the head cover, and
  - a joint aligning with the flexible sealing section in the axial direction,
  - the joint having a second fitting section fitting to the first fitting section of the flexible sealing section, the joint being harder than the sealing section,
- wherein the flexible sealing section further includes a neck portion at least in a region between the adhesion portion and the joint in the axial direction,
- wherein the neck portion is formed by partially narrowing the sealing section radially inwardly.

2. The ignition coil unit as claimed in claim 1, wherein the high tension tower includes a retainer located on a base end side in the axial direction relative to the joint to prevent removal of the sealing section, the retainer projecting radially outward,
- wherein the sealing section includes a recess to accommodate the retainer, wherein the neck portion is located at a position to overlap with the recess in the radial direction.

3. The ignition coil unit as claimed in claim 1, wherein the sealing section includes a convex portion at a position adjacent to a tip of the neck portion in the axial direction, the convex portion extending radially outside from an outer peripheral surface of the sealing section.

4. The ignition coil unit as claimed in claim 1, wherein the neck portion includes a prescribed length in the axial direction.

5. The ignition coil unit as claimed in claim 1, wherein the sealing section has a minimum diameter at the neck portion.

6. The ignition coil unit as claimed in claim 1, wherein the joint fitting section is cylindrical and includes:

an inner peripheral step inclining radially outward as an inner peripheral surface approaches a base end of the sealing section in the axial direction, and a base end inner peripheral surface extending from an end of the inner peripheral step to the base end, wherein a cavity is formed in a radial direction at least between either the inner peripheral step or the base end inner peripheral surface and the sealing section.

7. An ignition system comprising:

a cylinder head having a plug hole;

a head cover to cover the cylinder head, the head cover having an opening hole facing the plug hole; and an ignition coil unit inserted into both of the plug hole and the opening hole, the ignition coil unit including, a coil unit to generate a high voltage, the coil unit including, a main housing to accommodate components used in the coil unit, and an auxiliary housing to accommodate a cylindrical high tension tower protruding from the main housing to a tip side in an axial direction, and a cylindrical coupling unit extending in its axial direction to couple the coil unit to a spark plug while fitting to an outer peripheral surface of the cylindrical high tension tower, the cylindrical coupling unit including, an adhesion portion to tightly contact the head cover, and a neck portion on a tip side relative to the adhesion portion, wherein the neck portion is at least partially placed inside an opening end of the plug hole located on a base end side in the axial direction, wherein the neck portion is formed by partially narrowing the sealing section radially inside.

8. The ignition system as claimed in claim 7, wherein the coupling unit includes:

a flexible sealing section fitting to the outer peripheral surface of the high tension tower, the sealing section including a first fitting section at a tip of the sealing section; and a joint harder than the sealing section, the joint having a second fitting section fitting to the first fitting section, wherein the neck portion is formed in the sealing section at least between the adhesion portion and the joint in the axial direction.

9. The ignition system as claimed in claim 8, wherein the joint fitting section is cylindrical and includes:

an inner peripheral step inclining radially outside as an inner periphery goes on to a base end side in the axial direction; and a base end inner peripheral surface extending from an end of the inner peripheral step to a base end side in the axial direction, wherein a cavity is formed at least between either the inner peripheral step or the base end inner peripheral surface and the sealing section.

10. The ignition system as claimed in claim 7, wherein the high tension tower includes a retainer to prevent removal of the coupling unit, the retainer projecting radially outside;

wherein the coupling unit includes a recess to accommodate the retainer, wherein the neck portion is located at a position overlapping with the recess in the radial direction.

11. The ignition system as claimed in claim 7, wherein the coupling section includes a convex portion on its outer peripheral surface, the convex portion extending radially outside at a position adjacent to a tip side relative to the neck portion in the axial direction.

12. The ignition system as claimed in claim 7, wherein the neck portion has a prescribed length in the axial direction.

13. The ignition system as claimed in claim 7, wherein the coupling unit includes the minimum diameter at the neck portion.

* * * * *